US006400342B2

(12) United States Patent
Hirakawa

(10) Patent No.: US 6,400,342 B2
(45) **Date of Patent: *Jun. 4, 2002**

(54) METHOD OF DRIVING A PLASMA DISPLAY PANEL BEFORE ERASE ADDRESSING

(75) Inventor: Hitoshi Hirakawa, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/069,145

(22) Filed: Apr. 29, 1998

(30) Foreign Application Priority Data

Dec. 5, 1997 (JP) ..... 9-335288

(51) Int. Cl.[7] ..... G09G 3/28

(52) U.S. Cl. ..... 345/60; 345/67; 345/68; 315/169.4

(58) Field of Search ..... 345/60–72; 315/169.1, 315/169.4

(56) References Cited

U.S. PATENT DOCUMENTS 4,044,349 A * 8/1977 Andoh et al. ..... 345/60
4,772,884 A 9/1988 Weber et al.
5,231,382 A * 7/1993 Tanka ..... 345/60
5,247,288 A * 9/1993 Warren et al. ..... 345/60
5,250,936 A * 10/1993 Warren et al. ..... 345/60
5,430,458 A * 7/1995 Weber ..... 345/60
5,745,086 A * 4/1998 Weber ..... 345/63
5,854,540 A * 12/1998 Matsumoto et al. ..... 315/169.1
6,084,559 A * 7/2000 Nagao et al. ..... 345/67

FOREIGN PATENT DOCUMENTS

EP 0 657 861 A1 6/1995

* cited by examiner

*Primary Examiner*—Steven Saras
*Assistant Examiner*—Amr Awad
(74) *Attorney, Agent, or Firm*—Staas & Halsey, LLP

(57) ABSTRACT

A method for driving an plasma display panel according to the present invention uses an erase addressing for matrix display by an AC-driven plasma display panel. The method includes the steps of grouping the electrode pairs, which define rows, into a first group and a second group, and, as an operation to charge all the cells prior to the addressing, applying, to electrode pairs belonging to either one of the first and second groups, a first voltage for generating a discharge only in cells in a non-charged state and then a second voltage for generating a discharge in all the cells, and applying the second voltage to electrode pairs belonging to the other group.

21 Claims, 8 Drawing Sheets

METHOD OF DRIVING A PLASMA DISPLAY PANEL BEFORE ERASE ADDRESSING

CROSS-REFERENCE TO RELATED APPLICATION

This application is related to Japanese application No. HEI9(1997)-335288, filed on Dec. 5, 1997 whose priority is claimed under 35 USC §119, the disclosure of which is incorporated by reference in its entirety.

BACKGROUND OF THE INVENTION

1. Field of the Invention

The present invention relates to a method for driving an AC surface discharge plasma display panel (PDP).

For realizing display of a full motion picture like a television picture on a high-definition AC PDP, it is desirable to adopt a driving method which employs a so-call erase addressing, because the erase addressing is superior in speed to a write addressing.

2. Description of Related Art

Three-electrode AC surface discharge PDPs have become commercial as color display devices. The three-electrode AC surface discharge PDPs have pairs of main electrodes for sustaining light emission on individual rows and address electrodes on individual columns for matrix display. Since they are of AC-driven type, a memory function of a dielectric layer covering the main electrodes is utilized for display. That is, addressing is carried out to produce a charged state according to the content of display, and then a sustain voltage Vs of an alternating polarity for sustaining light emission is applied across all the main electrodes. Thereby, only in cells in which wall charge exists, an effective voltage Veff exceeds a firing voltage Vf to generate surface discharges along a substrate.

For displaying images in time sequence, uniformly charged state needs to be created on a whole screen during a period from the end of sustaining light emission for one image to the addressing for the next image in order to prevent disturbance of display. Accordingly, in the case of the erase addressing to erase wall charge from cells which need not be lighted, the entire screen must be uniformly charged prior to the addressing.

Conventionally, the wall charge is produced by applying a write voltage exceeding the firing voltage Vf simultaneously to all the pairs of main electrodes defining the individual rows on the screen. If the polarity of the write voltage is so chosen that a remaining wall charge lowers the effective voltage Veff, a discharge is selectively generated to produce wall charge only in cells in which the wall voltage is erased in the previous addressing. Then, by generating a discharge in all cells by use of this newly produced wall charge or the remaining wall charge, charge distribution can be made more even.

By carrying out the erase addressing, time necessary for the addressing can be shortened compared with the write addressing. More particularly, the write addressing requires about 3.7 $\mu$s per row for producing sufficient charge, while the erase addressing requires about 1.5 $\mu$s per row since the erase addressing needs only to eliminate charge.

However, when the entire screen is charged for preparation for the erase addressing, a strong discharge is generated in cells in a non-charged state by the write voltage. As a result, there is a problem in that, especially when a dark image is displayed, a background portion which occupies most of the screen is seen bright and thus contrast is reduced.

When a relatively bright image is displayed, unnecessary light emission in the preparation for the addressing is not so prominent.

SUMMARY OF THE INVENTION

An object of the present invention is to reduce the brightness of the background to improve the contrast.

In the present invention, on some rows, a discharge for preparation for the erase addressing is generated not by applying voltage, but by use of space charge generated by the discharge in rows adjacent to the rows. Thereby, the total number of discharges generated in a process for producing charge on the whole screen prior to the erase addressing is reduced.

The present invention provides a method for driving an plasma display panel by use of an erase addressing to erase wall charge in a cell which need not be lighted, after charging all cells on a screen, for matrix display by an AC-driven plasma display panel constructed to generate a surface discharge across electrode pairs which extend in a direction of rows and are covered with a dielectric layer, the method comprising the steps of grouping the electrode pairs, which define rows, into a first group and a second group in such a manner that an electrode pair of one group is adjacent to at least one electrode pair of the other group, and, as an operation to charge all the cells prior to the addressing, applying, to electrode pairs belonging to either one of the first and second groups, a first voltage for generating a discharge only in cells in a non-charged state and then a second voltage for generating a discharge in all the cells, and applying the second voltage to electrode pairs belonging to the other group.

DESCRIPTION OF THE PREFERRED EMBODIMENTS

In the present invention, odd-numbered electrode pairs may be grouped into the first group and even-numbered electrode pairs may be grouped into the second group. (The numbering of the electrode pairs starts at an end in the direction of columns.)

The application of the first voltage may be shifted between the first and second groups periodically.

Further, the electrode pairs may be grouped in such a manner that, between electrode pairs belonging to the group to which the first voltage is applied, there exist two electrode pairs belonging to the other group.

The second voltage applied to electrode pairs to which the first voltage is not applied may have a larger value than the second voltage applied to the other electrode pairs.

Electrode pairs to which the first voltage is not applied may receive the second voltage earlier than the other electrode pairs.

EXAMPLES

The present invention is now described in detail by way of example by reference to the accompanying drawings which should not be construed to limit the scope of the invention.

Figure 1:
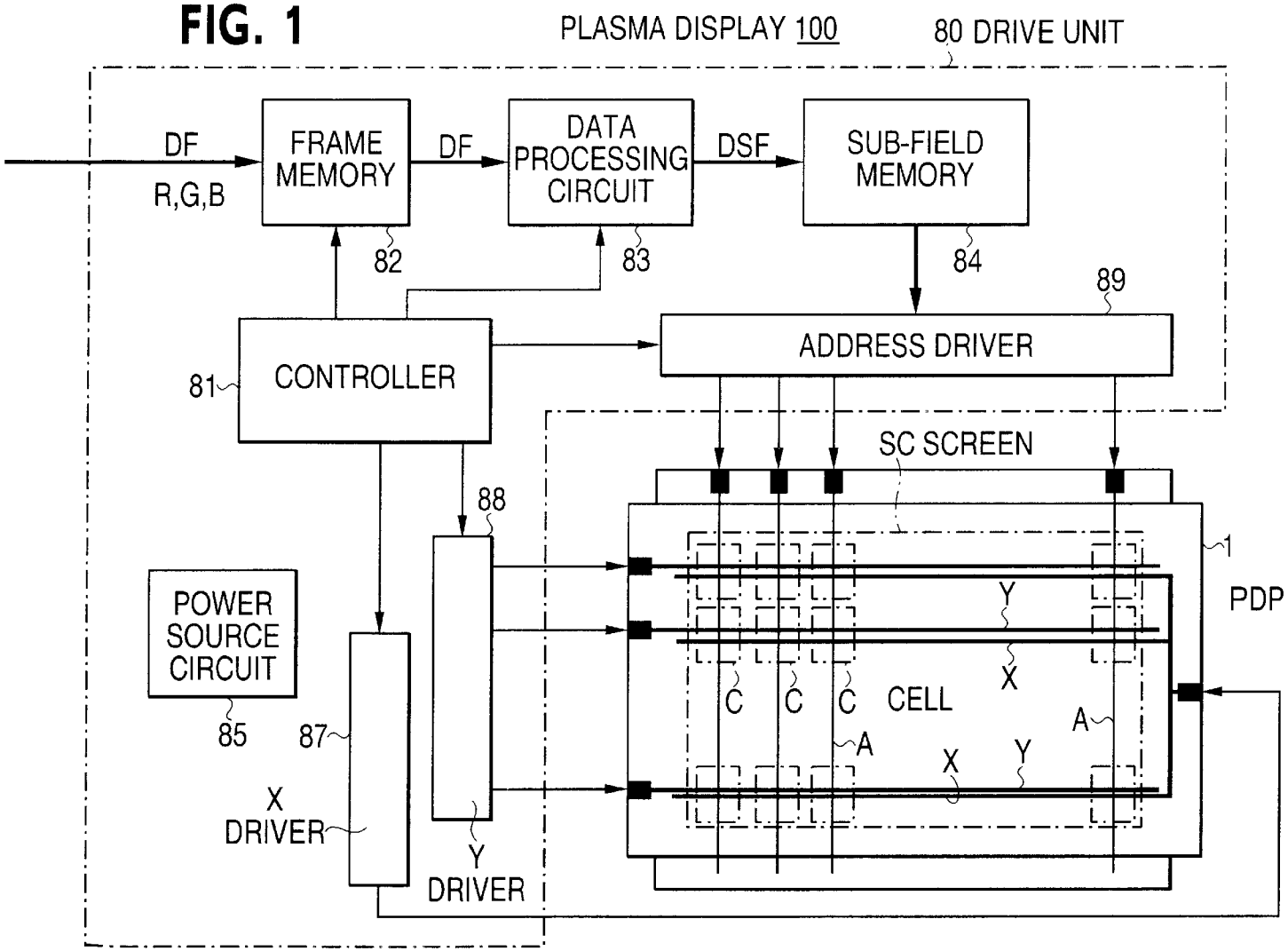
FIG. 1 is a diagram illustrating the structure of a plasma display device in accordance with the present invention.

FIG. 1 a diagram illustrating the structure of a plasma display 100 in accordance with the present invention.

The plasma display 100 includes an AC-driven PDP 1 which is a color display device of matrix system and a drive unit 80 for selectively lighting cells (i.e., discharge cells) C arranged in matrix which defines a screen SC. The plasma display 100 can be used as a wall-mountable television display or a monitor of a computer system.

The PDP 1 is a three-electrode surface discharge PDP in which pairs of sustain electrodes X and Y are disposed in parallel as first and second main electrodes and define cells at intersections with address electrodes A as third electrodes. The sustain electrodes X and Y extend in the direction of rows, i.e., in a horizontal direction, on the screen. The sustain electrodes Y are used as scanning electrodes for selecting cells C row by row in addressing. The address electrodes A extend in the direction of columns, i.e., in a vertical direction, on the screen and are used as data electrodes for selecting cells column by column in the addressing. An area where the sustain electrodes intersect the address electrodes is a display area, that is, the screen SC.

The drive unit 80 includes a controller 81, a frame memory 82, a data processing circuit 83, a sub-field memory 84, a power supply circuit 85, an X driver 87, a Y driver 88 and an address driver 89. To the drive unit 80, field data DF representing luminance levels (gradation levels) of individual colors R, G and B for each pixel is inputted from external devices such as a TV tuner, a computer or the like together with various kinds of synchronizing signals.

The field data DF is stored in the frame memory 82 and then transferred to the data processing circuit 83. The data processing circuit 83 is a data converter for conducting gradation display through dividing a field into a given number of sub-fields and outputs sub-field data DSF in accordance with the field data DF. The sub-field data DSF are stored in the sub-field memory 84. Each bit of the sub-field data has a value representing whether or not a cell must be lighted in a sub-field, more precisely whether or not the address discharge must be generated in a sub-field.

The X driver 87 applies a drive voltage to the sustain electrodes X, and the Y driver 88 applies a drive voltage to the sustain electrodes Y. The address driver 89 applies a drive voltage to the address electrodes A. To these drivers, the power supply circuit 85 supplies electric power.

Figure 2:
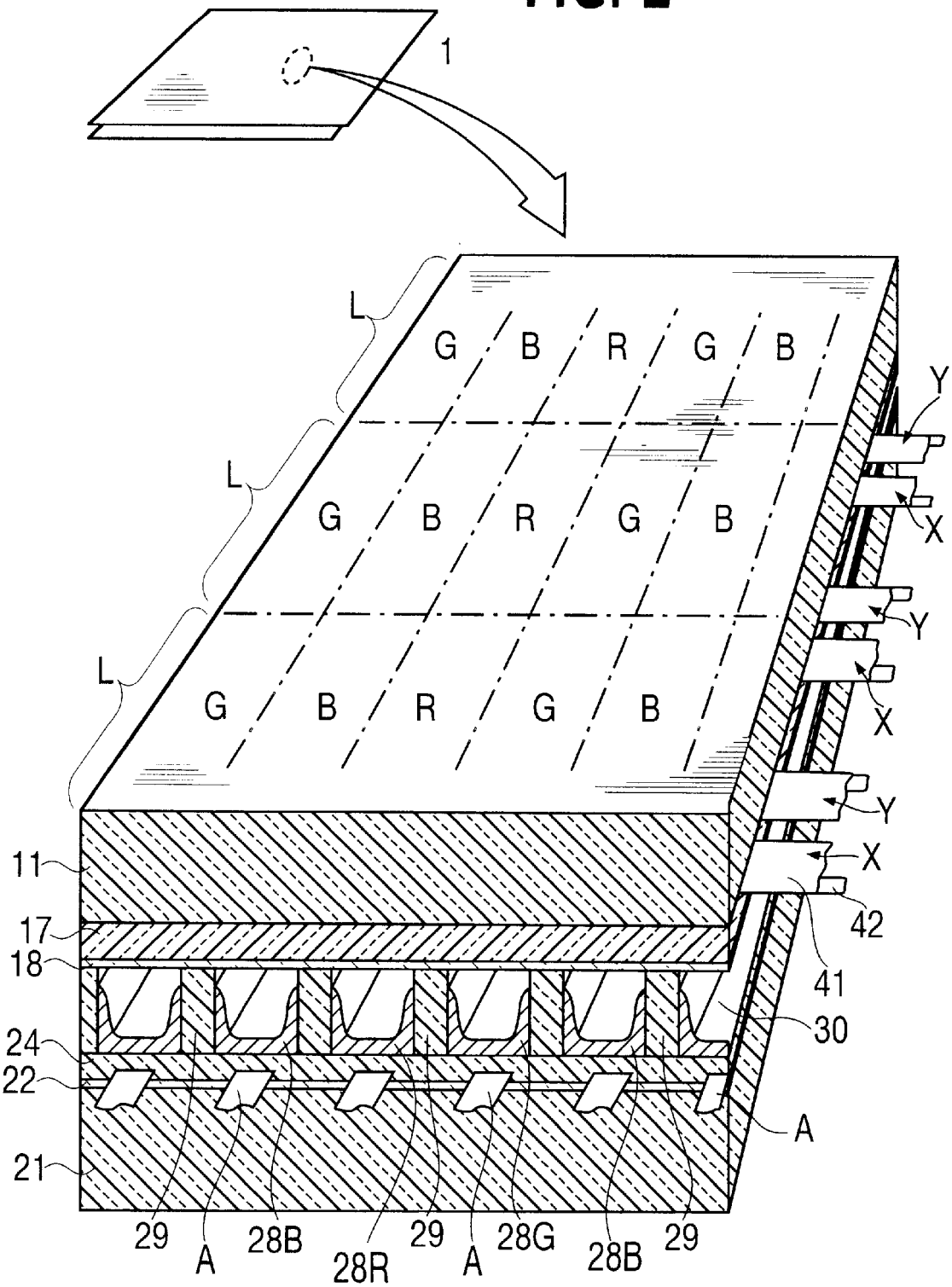
FIG. 2 is a perspective view illustrating the inner structure of a PDP.

FIG. 2 is a perspective view illustrating the inner structure of the PDP 1.

In the PDP 1, a pair of sustain electrodes X and Y is disposed on each row L on an inside surface of a front glass substrate 11. The row L is a line of cells in the horizontal direction on the screen. The sustain electrodes X and Y each include an electrically conductive transparent film 41 and a metal film (bus conductor) 42 and is covered with a dielectric layer 17 of a low-melting glass of about 30 $\mu$m thickness. A protection film 18 of magnesia (MgO) of several thousand Å thickness is provided on a surface of the dielectric layer 17. The address electrode A is disposed on a base layer 22 covering an inside surface of a rear glass substrate 21. The address electrode A is covered with a dielectric layer 24 of about 10 $\mu$m thickness. On the dielectric layer 24, ribs 29 of about 150 $\mu$m height are each disposed between the address electrodes A. The ribs 29 are in the form of a linear band in a plan view. These ribs 29 partition a discharge space 30 for each sub-pixel (a light-emission unit) in the row direction and also define a spacing for the discharge space 30. Fluorescent layers 28R, 28G and 28B of three colors R, G and B for color display are formed to cover walls on a rear substrate side including surfaces above the address electrodes A and side walls of the ribs 29. The discharge space 30 is filled with a discharge gas containing neon as the main component with which xenon is mixed. The fluorescent layers 28R, 28G and 28B are locally excited to emit light by ultraviolet rays irradiated by xenon when an electric discharge takes place. One pixel for display is composed of three sub-pixels adjacently placed in the row direction. The structural unit of each sub-pixel is a cell C (a display element). Since the ribs 29 are arranged in a stripe pattern, portions of the discharge space 3 which correspond to the individual columns are vertically continuous, bridging all the rows.

Now a method for driving the PDP 1 in the plasma display 100 is explained.

Figure 3:
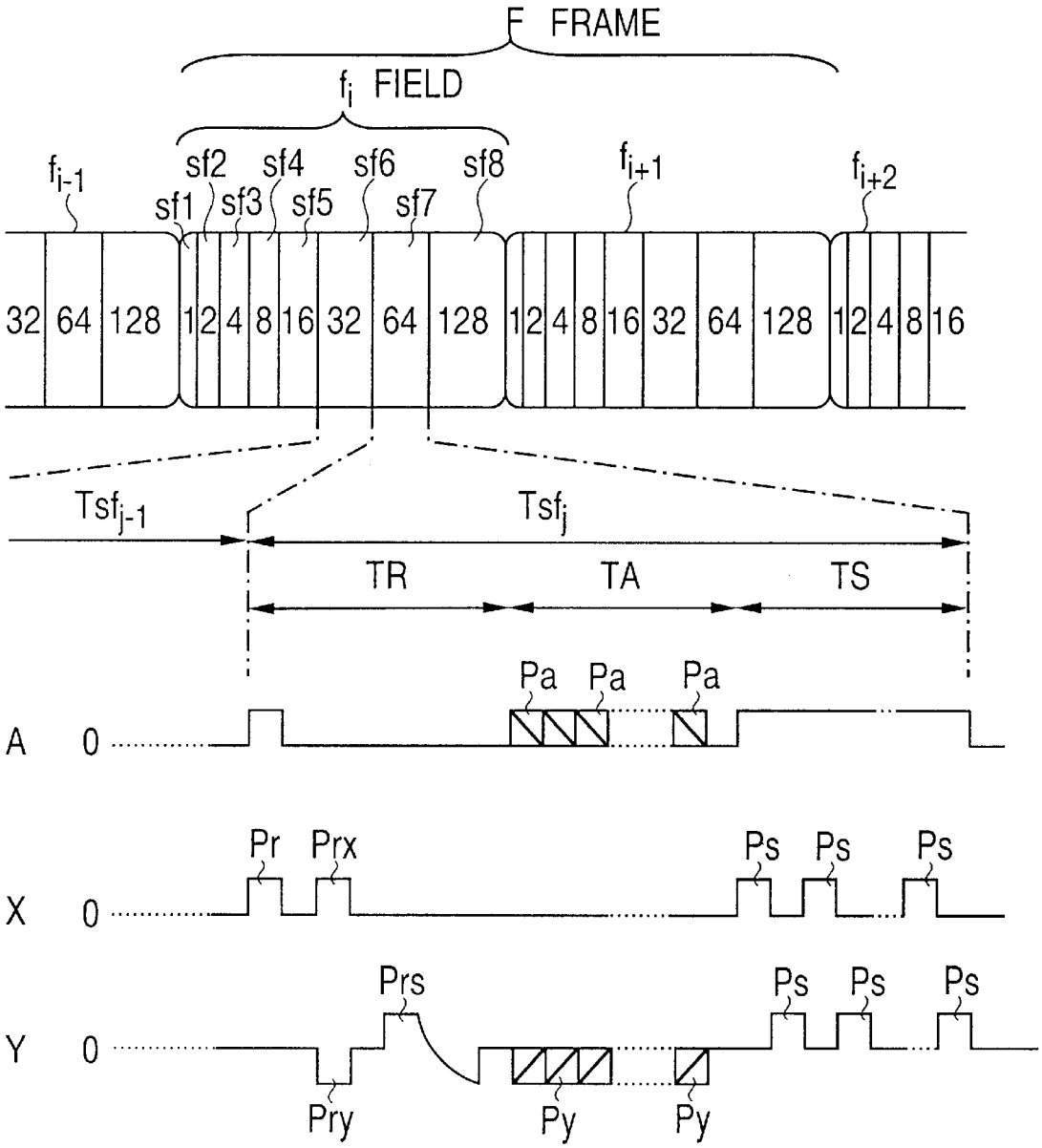
FIG. 3 illustrates a field structure and a drive sequence in accordance with the present invention.

FIG. 3 shows the structure of a field and a basic drive sequence.

For example, in the display of television pictures, time-sequential fields f which are inputted pictures are each divided, for example, into eight sub-frames sf1, sf2, sf3, sf4, sf5, sf6, sf7 and sf8 (numerals accompanying reference characters represent the order in which the sub-frames are displayed) for reproducing gray scales by binary control of lighting. In other words, the fields f composing a frame F are each replaced with a set of eight sub-frames sf1 to sf8. However, in the case where a non-interlaced type picture like an output of a computer is reproduced, each frame is divided into eight. The luminance of each of the sub-fields sf1 to sf8 is weighted in such a manner that relative ratio among the luminances of the sub-fields are 1:2:4:8:16:32:64:128. The number of sustain discharges in the sub-fields are set according to the weighted luminances of the respective sub-fields. The combination of ONs and OFFs on a sub-field basis can define 256 levels of luminance for each of the colors R, G and B and thus the number of displayable colors is $256^3$. The sub-fields sf1 to sf8 need not be displayed in the order of the weighted luminances thereof. The order can be optimized, for example, by putting the sub-field sf8 having the largest weighted luminance in the middle of a period for displaying the frame.

A sub-filed period Tsf allotted for each of the sub-fields sf1 to sf8 is comprised of an address preparation period TR for charging the whole screen uniformly, an address period TA for carrying out the erase addressing and a sustain period TS for sustaining an ON state for ensuring the luminance according to a gradation level to be displayed. In all the sub-field periods Tsf, the address preparation period TR and the address period TA are constant regardless of the weighted luminances assigned to the sub-fields, while the sustain period TS is longer as the weighted luminance assigned to a sub-field is larger. Therefore, the eight sub-field periods Tsf corresponding to one field f vary from one another.

In the address preparation period TR, basically, wall charge of a predetermined polarity is produced in "ON-state cells" which are lighted in the immediately preceding sub-field and in "OFF-state cells" which are not lighted in the immediately preceding sub-field through a first step of applying a voltage pulse Pr of positive polarity to the sustain electrode X and a second step of applying a voltage pulse Prx of a positive polarity and a voltage pulse Pry of negative polarity to the sustain electrode X and the sustain electrode Y, respectively. In the first step, the address electrode A is biased to a positive potential of about 50 to 120V for preventing an unnecessary discharge across the address electrode A and the sustain electrode X. Subsequently to the second step, a voltage pulse Prs of positive polarity is applied to the sustain electrode Y to generate a surface discharge in all the cells for the purpose of improving the uniformity of charge. This surface discharge reverses the polarity of the charge. Then, the potential of the sustain electrode Y is gradually reduced to a predetermined value for avoiding loss of the charge.

In the address period TA, the rows are selected one by one from a first row, and a scan pulse Py of negative polarity is applied to the selected rows. At the same time as the rows are selected, an address pulse Pa of positive polarity is applied to address electrodes A corresponding to cells to be off in the present sub-field. In a cell on the selected line to which the address pulse Pa is applied, an opposition discharge takes place across the sustain electrode Y and the address electrode A, and thereby the wall charge on the dielectric layer 17 is eliminated. Near the sustain electrode X, when the address pulse Pa is applied, there exists wall charge of positive polarity. The wall charge cancels the address pulse Pa and therefore a discharge does not take place across the sustain electrode X and the address electrode A. Such erase addressing is suitable for a high speed driving of the PDPs because it is not necessary to re-produce wall charge unlike the write addressing.

In the sustain period TS, all the address electrodes A are biased to a positive potential for preventing an unnecessary discharge. First, a sustain pulse Ps of positive polarity is applied to all the sustain electrodes X. Then, the sustain pulse Ps is applied alternately to the sustain electrode Y and to the sustain electrode X. In this embodiment, the last sustain pulse Ps in the sub-field is applied to the sustain electrode Y. By the application of the sustain pulse Ps, a discharge for display is generated in cells in which the wall charge is retained in the address period TA (i.e., cells to be ON in this sub-field).

Table 1 shows an example of the crest value and the pulse width of the pulses.

| Pulses | Crest Value (V) | Pulse width (μs) |
|---|---|---|
| Pr | Vs | 8 |
| Prx | Vs | 12 |
| Pry | −Vs | 12 |
| Prs | Vs | 12 |
| Py | −40 to −120 | 1.5 |
| Pa | 50 to 80 | 1.5 |
| Ps | 180 (Vs) | 2 |

Figure 4:
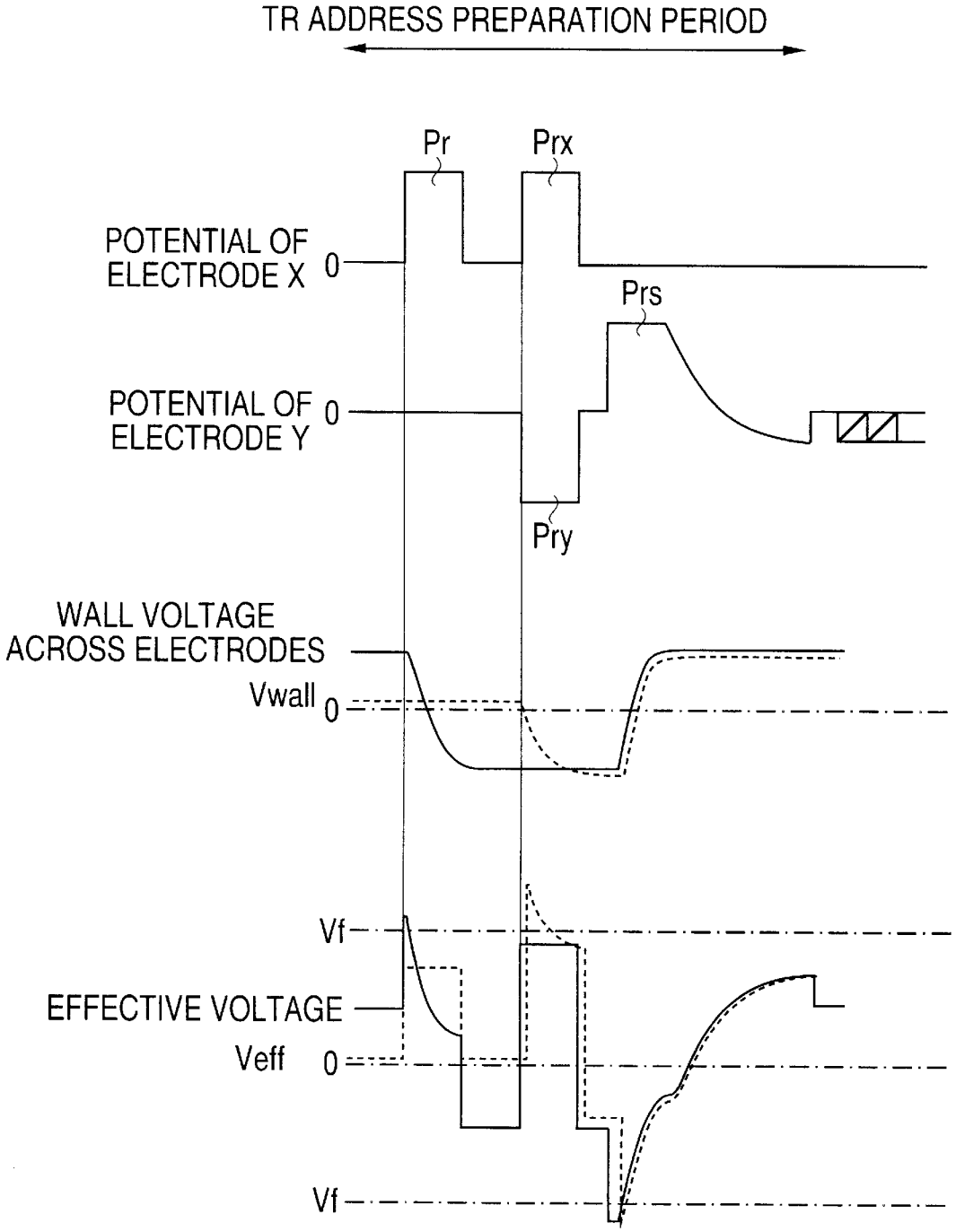
FIG. 4 shows exemplary voltage waveforms illustrating basic conception about address preparation in accordance with the present invention.

FIG. 4 shows exemplary voltage waveforms illustrating basic conception about the address preparation in accordance with the present invention. The polarity of the wall charge Vwall and effective voltage Veff is relative to the potential of the sustain electrode Y.

At the beginning of the address preparation period TR, there remains wall charge, which is produced by a surface discharge for sustaining light emission, in the ON-state cells which are lighted in the immediately preceding sub-field. The polarity of the wall charge is positive on a sustain electrode X side and negative on a sustain electrode Y side since the last sustain pulse Ps in the sustain period is applied to the sustain electrode Y. Therefore, in the ON-state cells, a positive wall charge is applied across the sustain electrodes (main electrodes). In the OFF-state cells which are not lighted in the immediately preceding sub-field, on the other hand, since the wall charge has been eliminated by the preceding addressing, the wall voltage Vwall is zero.

When the voltage pulse Pr having a crest value as high as or close to that of the sustain pulse Ps is applied to the sustain electrode X, the effective voltage Veff exceeds the firing voltage Vf in the ON-state cells lighted in the preceding sub-field, as shown with a solid line in the figure. Therefore, a surface discharge is generated in the ON-state cells. Thereby the wall charge is erased and then produced again. Thus the polarity of the wall voltage is reversed. In the OFF-state cells not lighted in the preceding sub-field, the effective voltage Veff does not exceed the firing voltage Vf as shown with a dotted line in the figure. Therefore, a discharge does not take place and the non-charged state is maintained.

Subsequently, the voltage pulses Prx and Pry of different polarities are applied. The crest values of the voltage pulses Prx and Pry are so set that the applied voltage is about twice as high as the sustain voltage for sustaining light emission (the crest value Vs of the sustain pulse PS). In the OFF-state cells, the effective voltage Veff exceeds the firing voltage Vf, so that a surface discharge is generated. Thereby, the same wall voltage Vwall of negative polarity as that present in the cells lighted in the preceding sub-field becomes present in the cells not lighted in the preceding sub-field. The voltage applied at this time is the first voltage of the present invention. In the cells lighted in the preceding sub-field, on the other hand, the wall voltage Vwall reduces the applied voltage and therefore the effective voltage Veff does not exceed the firing voltage Vf. Therefore, the charged state is maintained in the cells lighted in the preceding sub-field. Thus, the cells lighted and the cells not lighted in the preceding sub-field becomes in a similarly charged state. However, there arises a case where the amount of charge differs to some extent (usually, the cells not lighted in the preceding sub-field have a larger amount of charge). For the purpose of adjusting the amount of charge, the voltage pulse Prs is applied to generate a surface discharge in the cells lighted and not lighted in the preceding sub-field. This voltage pulse Prs is the second voltage of the present invention.

By charging the entire screen through the three steps as described above, a uniform charge distribution can be obtained and as a result, the discharge reliability is improved. However, as the voltage pulses Prx and Pry are applied to all the cells to create a discharge in the OFF-state cells not lighted in the preceding sub-field, the brightness of the background rises. Against this drawback, the rows L of the screen in the plasma display device 1 are divided into two groups. The voltage pulses Prx and Pry are applied only to pairs of sustain electrodes X and Y (referred to as electrode pairs) defining rows belonging to one of the two groups.

Figure 5:
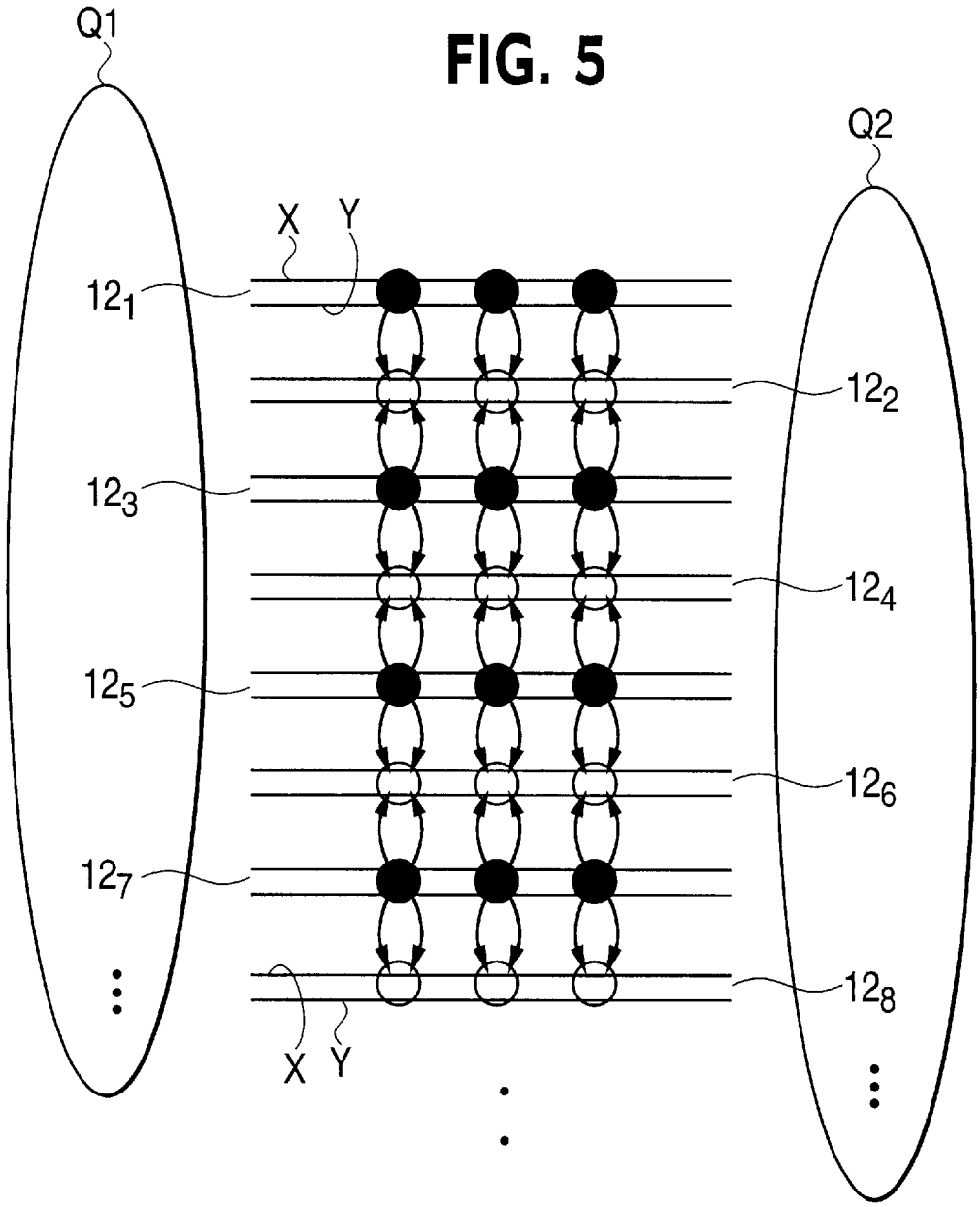
FIG. 5 shows an exemplary grouping of electrode pairs.

FIG. 5 shows an example grouping of electrode pairs.

Of the electrode pairs 12 arranged on the respective rows (numeral subscripts represents the order of arrangement), odd-numbered electrode pairs 12 are grouped in a first group Q1 and even-numbered electrode pairs 12 are grouped in a second group Q2. Here the numbering of the electrode pairs 12 starts with a row at an end in the direction of their arrangement (i.e., the direction of the columns on the screen). In this grouping, an electrode pair 12 of one group, except electrode pairs at both ends, is sandwiched between electrode pairs 12 of the other group. When a discharge is generated in a cell on an odd-numbered row which marked by a dark spot in the figure, for example, space charge spreads in the direction of the column (because the belt-like rib structure defines elongated discharge spaces extending in the direction of the columns and each of the discharge spaces includes therein cells situated in the same place on the rows), and the firing voltage is lowered by the priming effect in the even-numbered rows. That is to say, even though the voltage pulses Prx and Pry are not applied to the even-numbered rows, the voltage pulse Prs applied in the third step generates a surface discharge in the cells not lighted in the preceding sub-field within a time period during which the priming effect is effective. Additionally, the discharge generated by the voltage pulse Pr contributes to the priming effect in the case where the adjacent cells are lighted in the preceding sub-field.

Figure 6:
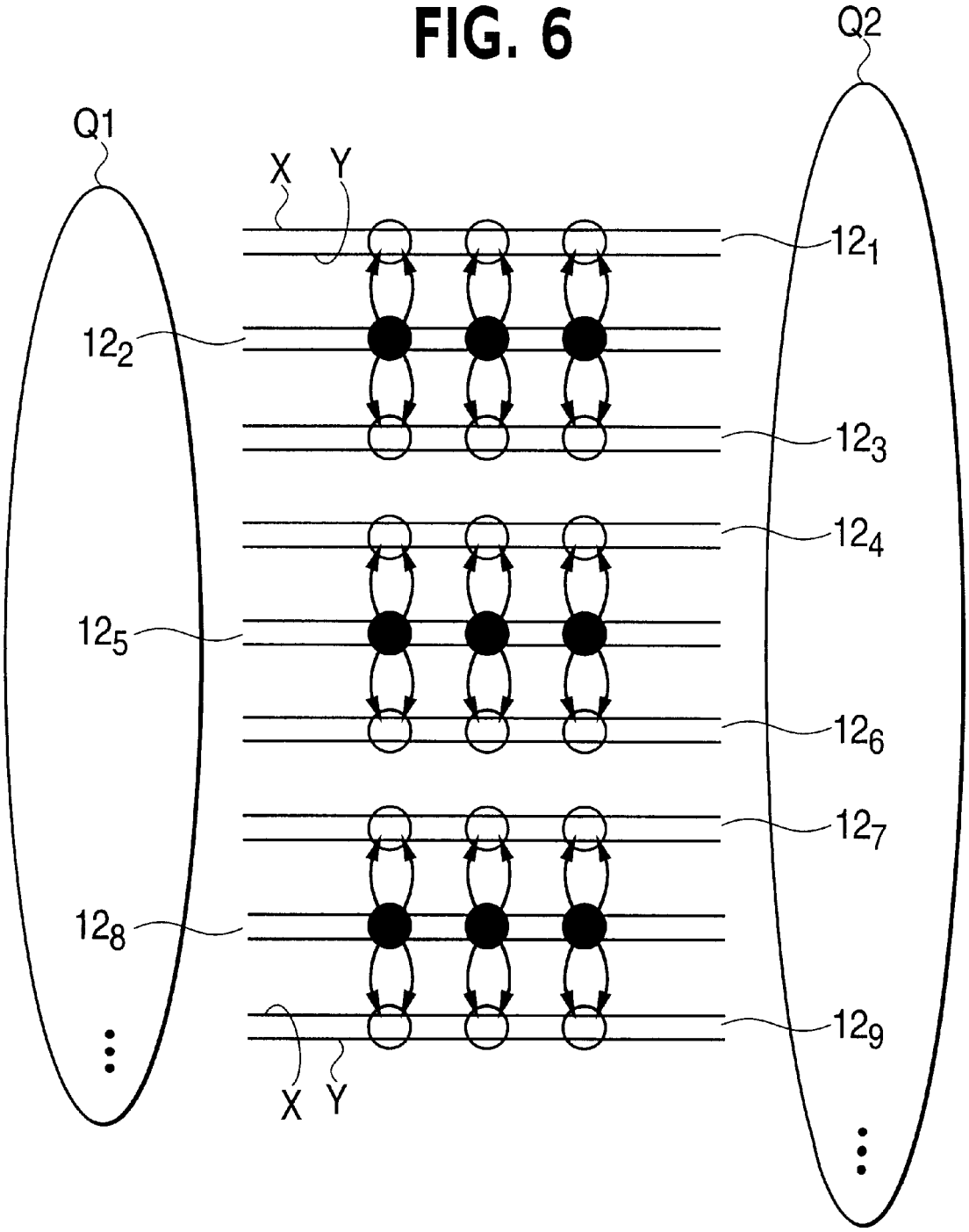
FIG. 6 shows another example of the grouping of electrode pairs.

FIG. 6 shows another example of the grouping of electrode pairs 12.

Of the electrode pairs 12 arranged on the respective rows, (2+3m)-th electrode pairs 12 (m represents an integer of 1 or more) are grouped into a first group Q1 and the other electrode pairs 12 are grouped into a second group Q2. Here the numbering of the electrodes pairs also starts with a row at an end in the direction of the columns. In this grouping, an electrode pair 12 of the first group Q1 is sandwiched between electrode pairs of the other group Q2, and an electrode pair 12 of the second group Q2 is adjacent to an electrode pair 12 of the other group Q1 on one side. It is optional which of the groups Q1 and Q2 receives the voltage pulses Prx and Pry, but a discharge by applying the voltage pulses Prx and Pry to the first group Q1 is more advantageous in view of uniformity of the priming effect.

Figure 7:
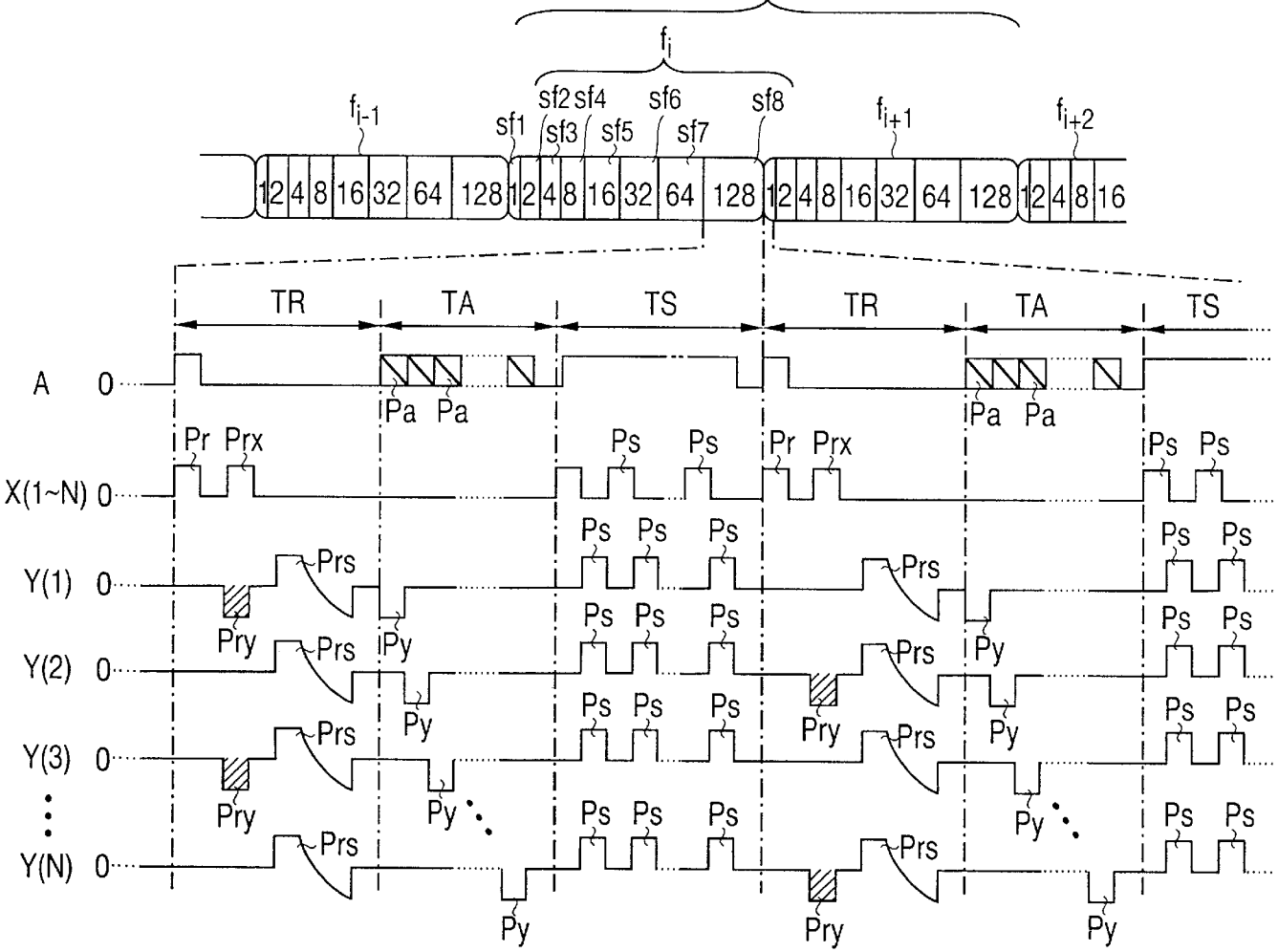
FIG. 7 shows voltage waveforms illustrating a drive sequence.

FIG. 7 shows voltage waveforms illustrating a drive sequence.

In the example shown in FIG. 7, the grouping illustrated in FIG. 5 is used. In a field f, the voltage pulse Pry is applied to the sustain electrode Y(1), Y(3), . . . of the odd-numbered electrode pairs which belong to the first group Q1 but not applied to the sustain electrode Y(2), Y(4), . . . of the even-numbered electrode pairs which belong to the second group Q2. The voltage pulse Prx is applied to all the sustain electrodes X (1 to N), but the voltage pulse Prx alone cannot create a discharge. In the next field f, the voltage pulse Pry is applied to the sustain electrode Y(2), Y(4), . . . of the even-numbered electrode pairs but not applied to the sustain electrode Y(1), Y(3), . . . of the odd-numbered electrode pairs. In other words, the application of the voltage pulse Pry is shifted between the groups Q1 and Q2 in every field f. By this operation, mis-discharges can be prevented from occurring only on certain rows. In addition, it is optional in what time period the application of the voltage pulse is switched. For example, it may be switched every sub-field.

Figure 8A:
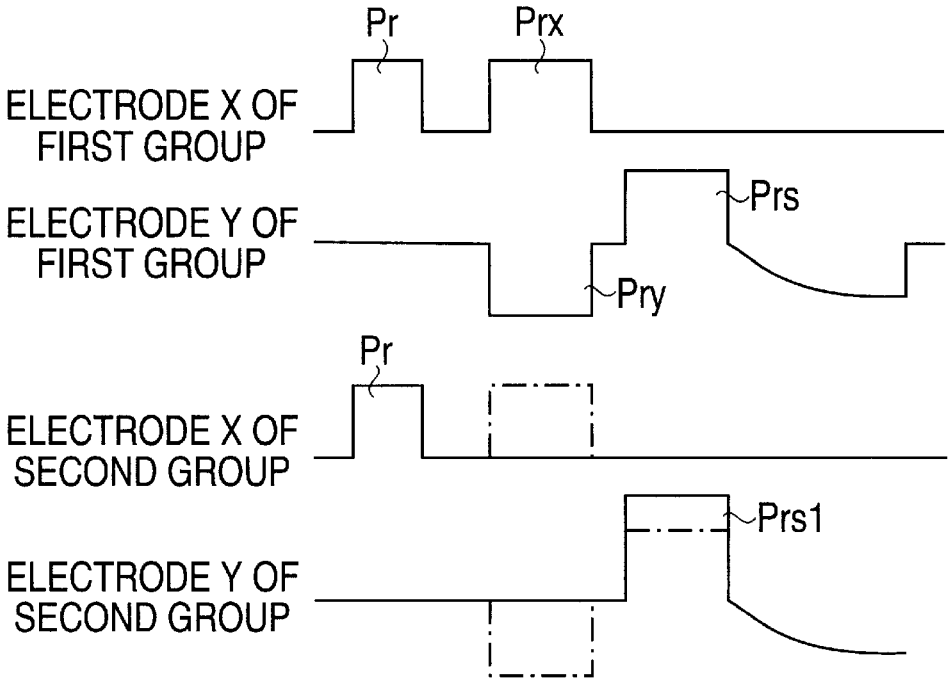
FIGS. 8A and 8B are modified waveforms of driving voltage.
Figure 8B:
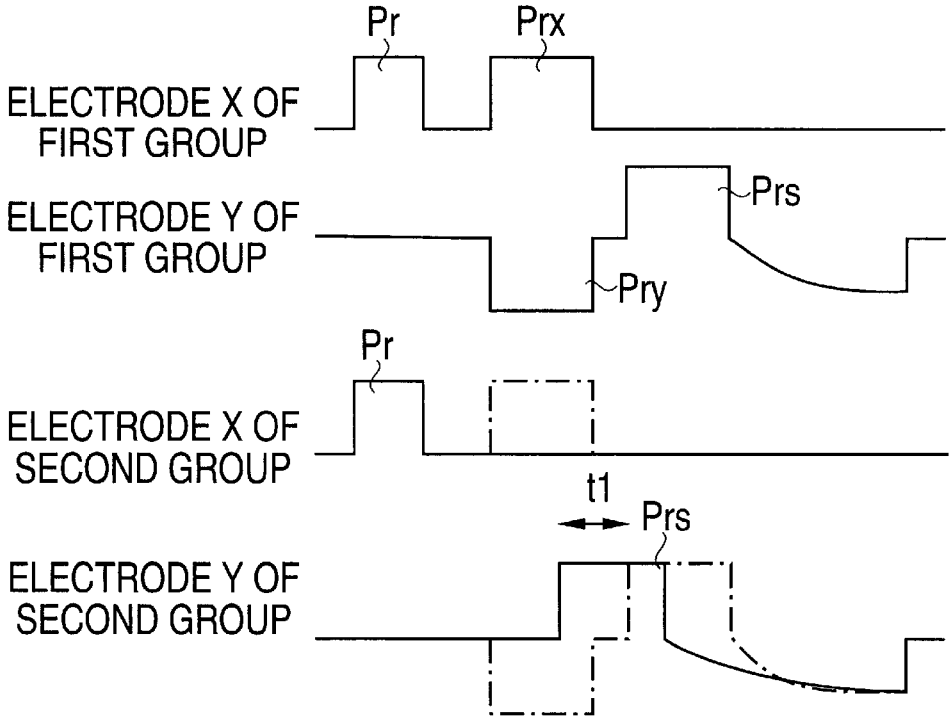

FIGS. 8A and 8B show modified waveforms of driving voltage.

In the example shown in FIG. 8A, the voltage pulses Prx and Pry are not applied to the electrode pairs 12 belonging to one group (e.g., the second group Q2). These electrode pairs receive a voltage pulse Prs1 whose crest value is higher than the voltage pulse Prs applied to the electrode pairs 12 belonging to the other group (e.g., the first group Q1). Since the discharge reliability is improved by raising the crest value, a discharge is surely generated in the cells not lighted in the preceding sub-field even if the application of the voltage pulses Prx and Pry is omitted.

In the example shown in FIG. 8B, the voltage pulses Prx and Pry are not applied to the electrode pairs 12 belonging to one group (e.g., the second group Q2). These electrode pairs receive the voltage pulse Prs earlier by a certain period of time t1 than the electrode pairs 12 belonging to the other group (e.g., the first group Q1) receive the voltage pulse Prs. The early application of the voltage pulse Prs is carried out while sufficient space charge is produced by the generation of the discharge by the voltage pulses Prx and Pry, for taking the most advantage of the priming effect. Since the discharge reliability is also improved in this case, a discharge is surely generated in the cells not lighted in the preceding sub-field even if the application of the voltage pulses Prx and Pry is omitted.

In the above-explained examples, the address pulse Pa is first set to be positive in order to reduce the deterioration of the fluorescent layers caused by the address discharge and then the polarities of the other pulses are determined. Further, only one type of sustain pulse Ps of the positive polarity is applied alternately to the sustain electrode pairs in order to simplify the drive circuitry. However, the present invention is not limited to these examples. The polarities of the applied voltages may be changed. With regard to the voltage pulses Prx and Pry in the second step related to the formation of the charge, the crest values may optionally be set, but it is advantageous to oppose them equipotentially like Vs and -Vs as seen in the examples in light of the construction of circuitry. Further, on the application of a so-called write voltage exceeding the firing voltage Vf like the application of the voltage pulses Prx and Pry, a discharge may be generated not only in the cells not lighted in the preceding sub-field but also in the cells lighted in the preceding sub-field. This case is more susceptible to non-uniformity in the charge that depends on the presence or non-presence of the remaining charge, but even if the application of the voltage pulses Prx and Pry to a certain cell is omitted, an equal priming effect can be expected whichever cell is adjacent to the cell, a cell lighted in the preceding sub-field or a cell not lighted in the preceding sub-field.

According to the present invention, the brightness in the background can be reduced and thereby the contrast can be improved.

What is claimed is:

1. A method for driving an plasma display panel having electrode pairs, each electrode pair defining a row having a plurality of cells, the method comprising:

grouping the electrode pairs into first and second groups so that an electrode pair of one group is adjacent to at least one electrode pair of the other group; and, prior to an erase addressing, applying to electrode pairs belonging to one of the first and second groups, a first voltage which generates a discharge only in cells in a non-charged state and then a second voltage which generates a discharge in all the cells, and applying a third voltage to electrode pairs belonging to the other group and having a relationship with respect to the second voltage to generate a surface discharge in all the cells and thereby improve uniformity of charge, wherein at least a portion of a time during which the third voltage is applied overlaps with a time during which the second voltage is applied.

2. The method according to claim 1, wherein odd numbered electrode pairs are grouped into the first group and even-numbered electrode pairs are grouped into the second group, the numbering of the electrode pairs starting at an end in a direction of a column.

3. The method according to claim 2, wherein the application of the first voltage is shifted between the first and second groups periodically.

4. The method according to claim 3, wherein the third voltage has a larger value than the second voltage, to thereby provide said relationship.

5. The method according to claim 3, wherein the third voltage is applied earlier than the second voltage, to thereby provide said relationship.

6. The method according to claim 2, wherein the third voltage has a larger value than the second voltage, to thereby provide said relationship.

7. The method according to claim 2, wherein the third voltage is applied earlier than the second voltage, to thereby provide said relationship.

8. The method according to claim 1, wherein the electrode pairs are grouped in such a manner that, between electrode pairs belonging to the group to which the first voltage is applied, there exist two electrode pairs belonging to the other group.

9. The method according to claim 1, wherein the third voltage has a larger value than the second voltage, to thereby provide said relationship.

10. The method according to claim 1, wherein the third voltage is applied earlier than the second voltage, to thereby provide said relationship.

11. A method for driving a plasma display panel having electrode pairs, each electrode pair defining a row having a plurality of cells, the method comprising:

grouping the electrode pairs into first and second groups so that an electrode pair of one group is adjacent to at least one electrode pair of the other group;

applying to electrode pairs belonging to one of the first and second groups, a first voltage which generates a discharge only in cells in a non-charged state and then a second voltage which generates a discharge in all the cells; and applying a third voltage to electrode pairs belonging to the other group and having a relationship with respect to the second voltage to generate a surface discharge in all the cells and thereby improve uniformity of charge, wherein at least a portion of a time during which the third voltage is applied overlaps with a time during the second voltage is applied.

12. The method according to claim 11, further comprising: performing erase addressing after the second voltage is applied.

13. The method according to claim 11, wherein the third voltage has a larger value than the second voltage, to thereby provide said relationship.

14. The method according to claim 11, wherein the third voltage is applied earlier than the second voltage, to thereby provide said relationship.

15. A method for driving a plasma display panel having electrode pairs, each electrode pair defining a row having a plurality of cells, the electrode pairs grouped into first and second groups so that an electrode pair of one group is adjacent to at least one electrode pair of the other group, the method comprising:

applying to electrode pairs belonging to one of the first and second groups, a first voltage which generates a discharge only in cells in a non-charged state and then a second voltage which generates a discharge in all the cells; and applying a third voltage to electrode pairs belonging to the other group and having a relationship with respect to the second voltage to generate a surface discharge in all the cells and thereby improve uniformity of charge, wherein at least a portion of a time during which the third voltage is applied overlaps with a time during the second voltage is applied.

16. The method according to claim 15, further comprising:

performing erase addressing after the second voltage is applied.

17. An apparatus comprising:

a plasma display panel having electrode pairs, each electrode pair defining a row having a plurality of cells, the electrode pairs grouped into first and second groups so that an electrode pair of one group is adjacent to at least one electrode pair of the other group;

means for applying to electrode pairs belonging to one of the first and second groups, a first voltage which generates a discharge only in cells in a non-charged state and then a second voltage which generates a discharge in all the cells; and means for applying a third voltage to electrode pairs belonging to the other group and having a relationship with respect to the second voltage to generate a surface discharge in all the cells and thereby improve uniformity of charge, wherein at least a portion of a time during which the third voltage is applied overlaps with a time during which the second voltage is applied.

18. A method for driving a plasma display panel by use of an erase addressing to erase wall charge in a cell which need not be lighted, after charging all cells on a screen, for matrix display by an AC-driven plasma display panel constructed to generate a surface discharge across electrode pairs which extend in a direction of rows and are covered with a dielectric layer, the method comprising:

grouping the electrode pairs, which define rows, into a first group and a second group in such a manner that an electrode pair of one group is adjacent to at least one electrode pair of the other group; and as an operation to charge all the cells prior to the addressing, applying, to electrode pairs belonging to either one of the first and second groups, a first voltage for generating a discharge only in cells in a non-charged state and then a second voltage for generating a discharge in all the cells to thereby generate a space charge, and applying a third voltage to electrode pairs belonging to the other group to thereby use said space charge to generate discharge across said electrode pairs belonging to said other group, wherein at least a portion of a time during which the third voltage is applied overlaps with a time during which the second voltage is applied.

19. A method for driving a plasma display panel having electrode pairs, each electrode pair defining a row having a plurality of cells, the method comprising:

grouping the electrode pairs into first and second groups so that an electrode pair of one group is adjacent to at least one electrode pair of the other group; and, prior to an erase addressing, applying to electrode pairs belonging to one of the first and second groups, a first voltage which generates a discharge only in cells to thereby generate a space charge, and relationship with respect to the second voltage, thereby using said space charge to generate discharge, wherein at least a portion of a time during which the third voltage is applied overlaps with a time during the second voltage is applied.

20. A method for driving a plasma display panel having electrode pairs, each electrode pair defining a row having a plurality of cells, the method comprising:

grouping the electrode pairs into first and second groups so that an electrode pair of one group is adjacent to at least one electrode pair of the other group;

applying to electrode pairs belonging to one of the first and second groups, a first voltage which generates a discharge only in cells in a non-charged state and then a second voltage which generates a discharge in all the cells to thereby generate a space charge; and applying a third voltage to electrode pairs belonging to the other group and having a relationship with respect to the second voltage thereby using said space charge to generate discharge across said electrode pairs belonging to said other group and improve uniformity of charge, wherein at least a portion of a time during which the third voltage is applied overlaps with a time during the second voltage is applied.

21. A method for driving a plasma display panel electrode pairs, each electrode pair defining a row having a plurality of cells, the electrode pairs grouped into first and second groups so that an electrode pair of one group is adjacent to at least one electrode pair of the other group, the method comprising:

applying to electrode pairs belonging to one of the first and second groups, a first voltage which generates a discharge only in cells in a non-charged state and then a second voltage which generates a discharge in all the cells to thereby generate a space charge; and applying a third voltage to electrode pairs belonging to the other group and having a relationship with respect to the second voltage to thereby use said space charge to generate discharge across said electrode pairs belonging to said other group and improve uniformity of charge, wherein at least a portion of a time during which the voltage is applied overlaps with a time during which the second voltage is applied.

* * * * *

UNITED STATES PATENT AND TRADEMARK OFFICE

CERTIFICATE OF CORRECTION

PATENT NO. : 6,400,342 B2
DATED : June 4, 2002
INVENTOR(S) : Hitoshi Hirakawa

It is certified that error appears in the above-identified patent and that said Letters Patent is hereby corrected as shown below:

Column 10,
Line 64, after "cells" insert -- in a non-charged state and then a second voltage which generates a discharge in all the cells --;
Line 65, after "and" insert (with new paragraph indentation)
-- applying a third voltage to electrode pairs belonging to the other group and having a --;
Line 67, after "discharge" insert -- across said electron pairs belonging to said other group and improve uniformity of charge --.

Column 12,
Line 1, after "panel" insert -- having --.

Signed and Sealed this

First Day of October, 2002

*Attest:*

*Attesting Officer*

JAMES E. ROGAN
*Director of the United States Patent and Trademark Office*